US010859211B2

(12) United States Patent
Bollinger

(10) Patent No.: US 10,859,211 B2
(45) Date of Patent: Dec. 8, 2020

(54) SEGMENTED VAPOR PLUG

(71) Applicant: CRYOPORT, INC., Irvine, CA (US)

(72) Inventor: Bret Bollinger, Yorba Linda, CA (US)

(73) Assignee: Cryoport, Inc., Irvine, CA (US)

( * ) Notice: Subject to any disclaimer, the term of this patent is extended or adjusted under 35 U.S.C. 154(b) by 177 days.

(21) Appl. No.: 16/025,811

(22) Filed: Jul. 2, 2018

(65) Prior Publication Data

US 2020/0003367 A1 Jan. 2, 2020

(51) Int. Cl.

| | |
|---|---|
| ***F17C 13/06*** | (2006.01) |
| ***F17C 3/08*** | (2006.01) |
| ***B65D 39/00*** | (2006.01) |

(52) U.S. Cl.

CPC ..... *F17C 13/06* (2013.01); *B65D 39/0052* (2013.01); *B65D 39/0076* (2013.01); *F17C 3/08* (2013.01); *F17C 2203/0329* (2013.01); *F17C 2203/0391* (2013.01)

(58) Field of Classification Search

CPC .... F17C 13/06; F17C 3/08; F17C 2203/0391; F17C 2203/0329; F17C 2203/0629; F17C 2201/032; F17C 2201/056; F17C 2201/058; F17C 2205/0311; F17C 2270/0509; B65D 39/0076; B65D 39/0052; B65D 39/007; B65D 39/0058

USPC ..... 215/355, 364, 320, 321

See application file for complete search history.

(56) References Cited

U.S. PATENT DOCUMENTS

| | | | | |
|---|---|---|---|---|
| 882,840 | A * | 3/1908 | Reid | B65D 39/02 215/363 |
| 2,449,645 | A * | 9/1948 | Du Pont | F42D 1/18 102/333 |
| 3,717,005 | A | 2/1973 | McGrew et al. | |
| 3,948,409 | A | 4/1976 | Ovchinnikov et al. | |
| 4,306,425 | A | 12/1981 | Sitte et al. | |
| 4,411,138 | A | 10/1983 | Leithauser et al. | |
| 4,455,842 | A | 6/1984 | Granlund | |
| 4,694,655 | A | 9/1987 | Seidel et al. | |
| 4,729,494 | A | 3/1988 | Peillon et al. | |
| 4,790,141 | A | 12/1988 | Glascock | |
| 6,467,642 | B2 | 10/2002 | Mullen et al. | |
| 6,539,360 | B1 | 3/2003 | Kadaba | |
| 7,627,926 | B2 | 12/2009 | Williams | |

(Continued)

FOREIGN PATENT DOCUMENTS

| | | | | |
|---|---|---|---|---|
| CH | 267226 A * | 3/1950 | | A45D 34/02 |
| DE | 3640852 A1 * | 6/1987 | | F17C 13/06 |

(Continued)

OTHER PUBLICATIONS

USPTO; Non-Final Office Action dated Dec. 2, 2011 in U.S. Appl. No. 12/658,641.

(Continued)

*Primary Examiner* — James N Smalley
(74) *Attorney, Agent, or Firm* — Snell & Wilmer L.L.P.

(57) ABSTRACT

Methods, apparatus, and device, such as a vapor plug, which partially seals an opening of a dewar. The vapor plug includes a vapor plug cover. The vapor plug cover is configured to cover an opening of a dewar. The vapor plug includes a neck that is formed from multiple disks and multiple sheets. The vapor plug includes a fastener that connects the multiple disks, the multiple sheets and the vapor plug cover.

18 Claims, 5 Drawing Sheets

(56) References Cited

U.S. PATENT DOCUMENTS

| | | | | |
|---|---|---|---|---|
| 7,881,987 | B1 | 2/2011 | Hart | |
| 8,220,107 | B2 | 7/2012 | Williams | |
| 8,397,343 | B2 | 3/2013 | Williams | |
| 9,292,824 | B1 | 3/2016 | Freeman | |
| 9,378,442 | B2 | 6/2016 | Barnings | |
| 2002/0099567 | A1 | 7/2002 | Joao | |
| 2002/0102992 | A1 | 8/2002 | Koorapaty | |
| 2002/0166326 | A1 | 11/2002 | Giesy et al. | |
| 2002/0167500 | A1 | 11/2002 | Gelbman | |
| 2003/0137968 | A1 | 7/2003 | Lareau et al. | |
| 2004/0215532 | A1 | 10/2004 | Boman | |
| 2004/0236635 | A1 | 11/2004 | Publicover | |
| 2005/0046584 | A1 | 3/2005 | Breed | |
| 2005/0171738 | A1 | 8/2005 | Kadaba | |
| 2005/0234785 | A1 | 10/2005 | Burman | |
| 2005/0246192 | A1 | 11/2005 | Jauffred et al. | |
| 2006/0043055 | A1* | 3/2006 | Wang | B65D 39/0058 215/305 |
| 2006/0080819 | A1 | 4/2006 | McAllister | |
| 2006/0168644 | A1 | 7/2006 | Richter et al. | |
| 2007/0009119 | A1 | 1/2007 | Pohle et al. | |
| 2007/0028642 | A1 | 2/2007 | Glade et al. | |
| 2007/0268138 | A1 | 11/2007 | Chung et al. | |
| 2008/0094209 | A1 | 4/2008 | Braun | |
| 2008/0162304 | A1 | 7/2008 | Ourega | |
| 2008/0291033 | A1 | 11/2008 | Aghassipour | |
| 2009/0014537 | A1 | 1/2009 | Gelbman | |
| 2009/0293524 | A1 | 12/2009 | Vezina et al. | |
| 2009/0314835 | A1 | 12/2009 | Jackson | |
| 2010/0080168 | A1 | 4/2010 | Fukuyama | |
| 2010/0299278 | A1 | 11/2010 | Kriss et al. | |
| 2011/0084415 | A1 | 4/2011 | Kim et al. | |
| 2011/0216178 | A1 | 9/2011 | Carpenter | |
| 2016/0061384 | A1 | 3/2016 | Caldwell et al. | |

FOREIGN PATENT DOCUMENTS

| | | |
|---|---|---|
| JP | 3958213 | 5/2018 |
| KR | 20-0461105 | 6/2012 |
| KR | 10-2014-0062606 | 5/2014 |
| WO | 2002053967 | 11/2002 |

OTHER PUBLICATIONS

USPTO; Final Office Action dated Aug. 14, 2012 in U.S. Appl. No. 12/658,641.

USPTO; Non-Final Office Action dated Sep. 11, 2015 in U.S. Appl. No. 12/658,641.

USPTO; Non-Final Office Action dated Dec. 11, 2012 in U.S. Appl. No. 12/852,413.

USPTO; Final Office Action dated May 10, 2012 in U.S. Appl. No. 12/852,413.

USPTO; Advisory Action dated Jul. 31, 2012 in U.S. Appl. No. 12/852,413.

USPTO; Non-Final Office Action dated Jun. 18, 2014 in U.S. Appl. No. 12/852,413.

USPTO; Non-Final Office Action dated Jun. 17, 2016 in U.S. Appl. No. 12/852,413.

USPTO; Final Office Action dated Nov. 29, 2016 in U.S. Appl. No. 12/852,413.

USPTO; Non-Final Office Action dated Jul. 25, 2017 in U.S. Appl. No. 14/589,768.

USPTO; Final Office Action dated Feb. 7, 2018 in U.S. Appl. No. 14/589,768.

USPTO; Non-Final Office Action dated Jun. 19, 2018 in U.S. Appl. No. 14/589,768.

USPTO; Final Office Action dated Dec. 27, 2018 in U.S. Appl. No. 14/589,768.

PCT; International Search Report dated May 31, 2002 in International Application No. PCT/US2001/049684.

PCT; International Search Report dated Jun. 28, 2010 in International Application No. PCT/US2010/023252.

PCT; Written Opinion of International Search Authority dated Jun. 28, 2010 in International Application No. PCT/US2010/023252.

PCT; International Preliminary Report on Patentability dated Mar. 22, 2013 in International Application No. PCT/US2010/023252.

Electronic Reusable Paper, http://www2.parc.com/hsl/projects/gyricon/, (Oct. 2005).

KIPO; International Search Report and Written Opinion dated Oct. 21, 2019 in PCT Application No. PCT/US2019/040141.

* cited by examiner

SEGMENTED VAPOR PLUG

BACKGROUND

1. Field

This specification relates to a system, device or apparatus for plugging or partially sealing a cryogenic device that stores and/or transports a liquid or gas under cryogenic temperatures.

2. Description of the Related Art

Lab technicians, scientists, medical professionals, such as doctors or nurses, and other technicians may cryogenically store and transport material to various facilities, such as hospitals, labs and research facilities. When transporting the material at a cryogenic temperature, the technicians and/or professionals store the material in a dry vapor shipper. The dry vapor shipper is a vacuum insulated container that is used to transport the material. The dry vapor shipper may be a dewar that has an inner vessel with a thin-walled neck tube and an outer vessel. The inner wall of the inner vessel may have an absorbent material, such as a liquid or a gas. A vapor plug may act like a cork to partially seal an opening of the dewar.

The vapor plug partially seals the opening to allow the liquid or gas to escape so that pressure does not build up inside the dewar and cause an explosion. As the gas or liquid escapes, warm air is drawn into the dewar, which may cause further evaporation of the gas or liquid.

Accordingly, there is a need for a system, device or apparatus that reduces the evaporation of the gas or liquid while equalizing the pressure within the dewar.

SUMMARY

In general, one aspect of the subject matter described in this specification is embodied in a vapor plug. The vapor plug includes a vapor plug cover configured to cover an opening of a container such as a dewar. The vapor plug includes a neck that is formed from multiple disks and multiple sheets. The vapor plug includes a fastener that connects the multiple disks, the multiple sheets and the vapor plug cover.

These and other embodiments may optionally include one or more of the following features. The multiple sheets may form multiple protrusions that extend outward from the neck. The multiple protrusions may be configured to obstruct gas or liquid that escapes the dewar. The multiple protrusions may reduce evaporation of the gas or liquid within the dewar. Each protrusion of the multiple protrusions may be a fin.

Each disk of the multiple disks may have a top surface and a bottom surface. The top surface may have a dimple and the bottom surface may have a cavity. The shape of the dimple may correspond with the shape of the cavity. The multiple disks may include a first disk and a second disk. The dimple of the first disk may interlock with the cavity of the second disk.

The vapor plug cover may have a recess that is configured to receive the fastener. The fastener may have a pin that is configured to be inserted into the recess of the vapor plug cover. The pin may be inserted through an opening in each disk and in each sheet to connect the multiple disks and the multiple sheets with the vapor plug cover. The fastener may have a push nut and a plate. The plate may be positioned at an end of the neck and may be opposite the vapor plug cover. The multiple disks and the multiple sheets may be positioned in between the vapor plug cover and the plate. The head of the pin may be configured to push against the push nut and plate to hold the plurality of disks and the plurality of sheets in between the plate and the vapor plug cover.

The neck may have a thermocouple channel. Each disk may have a channel that is aligned with the channel of the other disks to form the thermocouple channel of the neck when the multiple disks form the neck. The multiple disks may be made from a polystyrene material and the multiple sheets may be formed from Tyvek.

In another aspect, the subject matter is embodied in a cryogenic storage or transport system. The cryogenic storage or transport system includes a dewar having an inner vessel and an outer vessel. The cryogenic storage or transport system includes a vapor plug positioned within the inner vessel of the dewar such that there is a gap between the vapor plug and the inner vessel. The vapor plug has a vapor plug cover that is configured to cover an opening of a dewar and a neck formed from a plurality of disks and a plurality of sheets. The neck has a thermocouple channel. The vapor plug has a fastener that connects the multiple disks, the multiple sheets and the vapor plug cover.

In another aspect, the subject matter is embodied in a vapor plug. The vapor plug includes a vapor plug cover that is configured to cover an opening of a dewar. The vapor plug includes multiple disks and multiple sheets. Each sheet of the multiple sheets is sandwiched in between two disks. The vapor plug includes a fastener that is configured to connect the vapor plug, the multiple disks and the multiple sheets.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale, and may be exaggerated to better illustrate the important features of the present invention.

DETAILED DESCRIPTION

Disclosed herein are systems, apparatuses and devices for partially sealing an inner vessel of a container, such as a dewar. The dewar may be a double-walled vacuum insulated container that is used to transport commodities at cryogenic temperatures. The dewar may have an inner wall that is lined with an absorbent material and an outer wall, which forms an inner vessel and an outer vessel. The inner vessel of the dewar may have a neck portion. The neck portion may have an opening that receives the material and stores the material in the inner vessel. The absorbent material may be a liquid or gas.

A segmented vapor plug may act like a cork to partially seal the opening and reduce the amount of liquid or gas that evaporates, while also equalizing the pressure within the dewar so that pressure does not build up within the dewar. By reducing the amount of liquid or gas that evaporates, the segmented vapor plug also minimizes the amount of warm air that is pulled in to replace the evaporated liquid or gas, which prolongs the amount of time that the dewar can maintain the cryogenic temperatures.

Other benefits and advantages of the segmented vapor plug including having one or more flexible fins. By having flexible fins, the segmented vapor plug adapts to the environmental conditions within the inner vessel of the dewar. For example, the flexible fins may bend, which allows the pressure to equalize if the pressure builds up within the inner vessel. When the pressure is equalized, the flexible fins may act as gates that slow incoming warm air from filling the inner vessel, which reduces the overall evaporation of the liquid or gas within the inner vessel and prolongs the amount of time that the dewar can maintain the cryogenic temperatures.

Figure 1A:
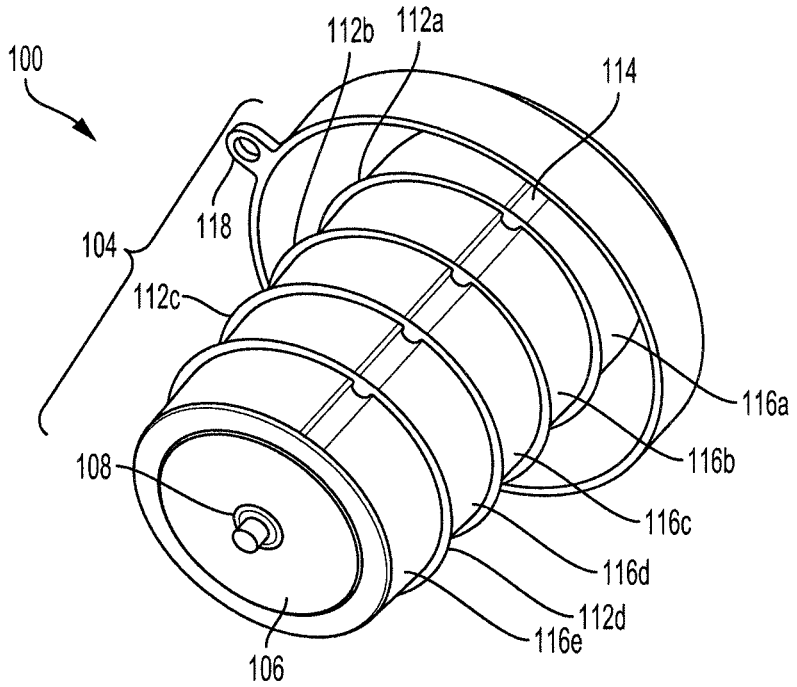
FIG. 1A shows an example segmented vapor plug according to an aspect of the invention.
Figure 1B:
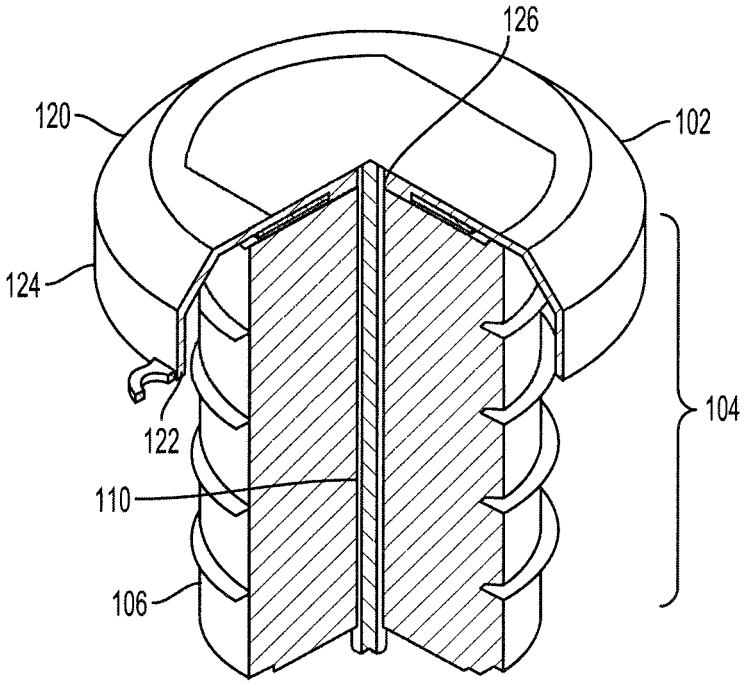
FIG. 1B shows a cross-sectional view of the segmented vapor plug of FIG. 1 according to an aspect of the invention.

FIGS. 1A-1B show a segmented vapor plug 100 according to one aspect of the invention. FIG. 1A shows an exterior view of the segmented vapor plug 100. FIG. 1B shows a cross-sectional view of the segmented vapor plug 100. The segmented vapor plug 100 reduces evaporation of a liquid or gas in a dewar 202 when the segmented vapor plug 100 is inserted into an opening of the dewar 202. The segmented vapor plug 100 may partially seal the dewar 202. That is, the segmented vapor plug 100 allows the liquid or gas to escape the dewar 202 to equalize the pressure within the dewar 202, but may also, obstruct and/or reduce the amount of liquid or gas that escapes to prevent evaporation and prevent the warm air from entering into the dewar 202. This maintains the cryogenic temperatures within the dewar 202 to allow for continued cryogenic storage of the material stored within the dewar 202.

In one aspect of the present invention, the segmented vapor plug 100 is removable. Specifically, the segmented vapor plug 100 may be inserted into an opening of the dewar 202 to partially seal and/or limit access to a cavity of the dewar 202. The segmented vapor plug 100 may be removed from the cavity of the dewar 202 to allow liquid and/or gas to escape from the cavity of the dewar 202.

The segmented vapor plug 100 may made from a single component, multiple components that are interconnected, such as a vapor plug cover 102 and a neck 104, or separate components. In one aspect of the present invention, the segmented vapor plug 100 is a unitary interconnected piece, the segmented vapor plug 100 may have a neck 104 that includes one or more disks 116*a-e* interconnected with one or more sheets 112*a-d*, for example as shown in FIGS. 1A-1B, or other similar devices. The segmented vapor plug 100 may have a plate 106, thermocouple channel 114 and/or a fastener. The fastener may include a nut 108, a tube 602, and/or a central pin 502. The segmented vapor plug 100 may use the fastener or other fastening device to interconnect the different pieces or components. In other aspects of the present invention, the segmented vapor plug 100 may include multiple pieces that are not interconnected.

Figure 2:
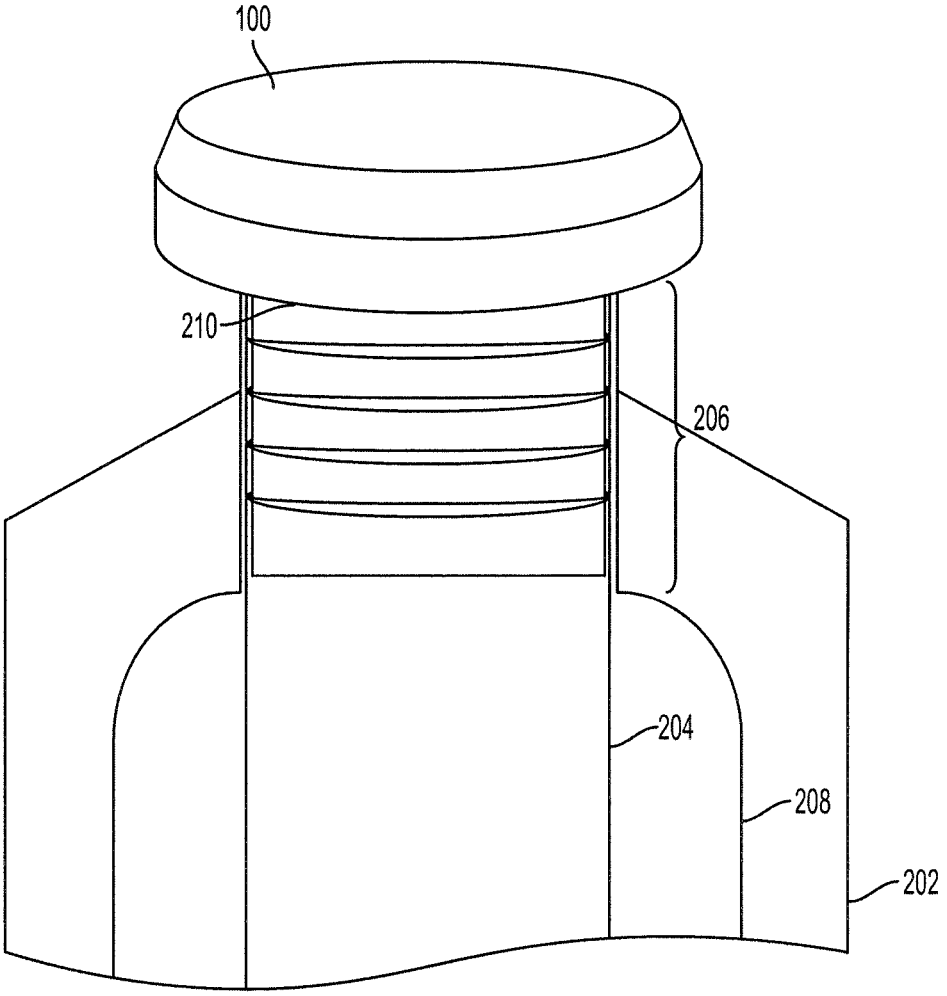
FIG. 2 shows an example of the segmented vapor plug of FIG. 1 inserted into a dewar according to an aspect of the invention.

The segmented vapor plug 100 includes a vapor plug cover 102. The vapor plug cover 102 may be circular-shaped or shaped in another polygon. The vapor plug cover 102 may have a handle to allow for ease of access for removing and/or inserting the segmented vapor plug 100 into the opening of the dewar 202 to partially seal the cavity of the dewar 202, as shown in FIG. 2 for example. The vapor plug cover 102 may be made from a polymeric material. This allows the vapor plug cover 102 to withstand cryogenic temperatures so that the vapor plug cover 102 does not shatter because of brittleness when exposed to cryogenic temperatures.

The vapor plug cover 102 may have various other features to assist in removing and/or inserting the segmented vapor plug 100 into and out of the dewar 202. The various features may include a cover protrusion 118. Other features such as a lip 124 may assist in partially sealing the dewar 202 while allowing gas or liquid to escape to equalize the pressure within the dewar 202.

The cover protrusion 118 may be positioned at an edge of the vapor plug cover 102 and may have an opening. The opening of the cover protrusion 118 may receive a fastening device, such as a lanyard, a rope, a wire or other fastening device. The fastening device may be inserted into the opening. The fastening device, when connected to the cover protrusion 118 through the opening, allows the segmented vapor plug 100 to be easily carried, secured and/or removed.

The lip 124 may be positioned at an edge of the vapor plug cover 102 and may be angled outward away from the neck 104. This creates a gap in between the lip 124 of the vapor plug cover 102 and the neck 104, which allows liquid or gas to escape and facilitates the equalization of the pressure within the dewar 202 when the segmented vapor plug 102 is inserted into the opening of the dewar 202. Moreover, the lip 124 may partially cover the opening, and thus, may obstruct the evaporation of the liquid or gas within the dewar 202.

The vapor plug cover 102 has an outer surface 120 and an inner surface 122. In one aspect of the present invention, the vapor plug cover 102 has a recess or other interface that connects to a fastener to interconnect the vapor plug cover 102 with the other components to form the unitary interconnected piece. For example, the vapor plug cover 102 may have a recess 126 within the inner surface 122. The recess 126 may be centrally located with respect to a perimeter of the vapor plug cover 102. The recess 126 may receive a fastener, which interconnects the multiple disks 116*a-e* and the one or more sheets 112*a-d* to form the neck 104.

In one aspect of the present invention, a neck 104 is interconnected with the vapor plug cover 102 to form the unitary interconnected piece. For example, the neck 104 may be connected to an inner surface 122 of the vapor plug cover 102 via a fastener. The neck 104 may be shaped as a cylinder and be made from polystyrene material, closed-cell phenolic foam or other insulator and may have an outer diameter that is less than the inner diameter of the opening or neck portion 206. The gap or clearance allows the gas or liquid to escape from the cavity of the inner vessel 204.

The dewar 202 may have an inner vessel 204 and an outer vessel 208. The gap between the inner vessel 204 and the outer vessel 208 may be vacuum insulated. The dewar 202 may have an opening 210 that leads to a neck portion 206 and a cavity of the inner vessel 204. The neck portion 206 and the opening 210 may have an inner diameter that is greater than an outer diameter of the neck 104 of the segmented vapor plug 100, which allows the neck portion 206 and/or the opening 210 to receive the neck 104 and maintain a gap between the neck 104 and the neck portion 206 of the inner vessel 204 of the dewar 202. The gap may be approximately 0.25 inches. This gap allows gas or liquid to escape from the cavity of the inner vessel 204 to equalize pressure within the dewar 202, when pressure builds-up.

In one aspect of the present invention, the neck 104 may be comprised of various disks or other similar devices to help partially seal a gas or liquid in the dewar 202. The other similar devices may include one or more sheets 112*a-d*. The one or more disks 116*a-e* and/or the one or more sheets 112*a-d* may be shaped as a cylinder or other three-dimensional polygon. The one or more disks 116*a-e* when interconnected with the one or more sheets 112*a-d* may form the neck 104.

Figure 3A:
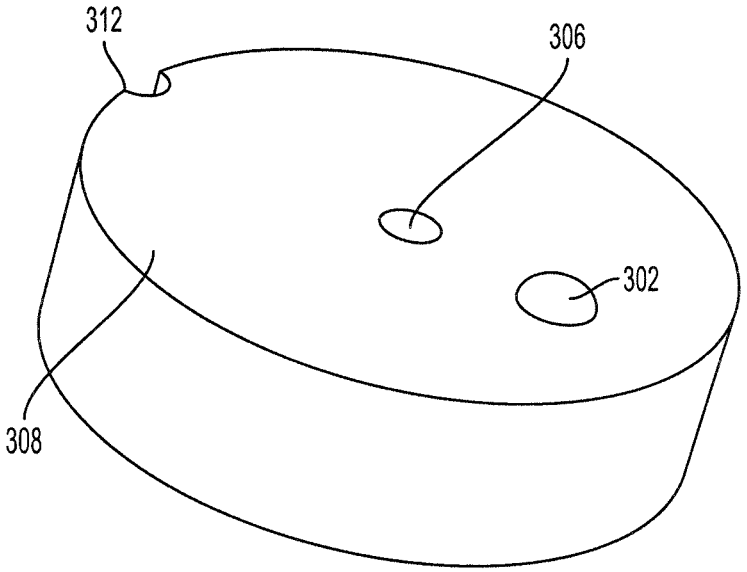
FIG. 3A shows a top perspective view of an example disk of the segmented vapor plug of FIG. 1 according to an aspect of the invention.
Figure 3B:
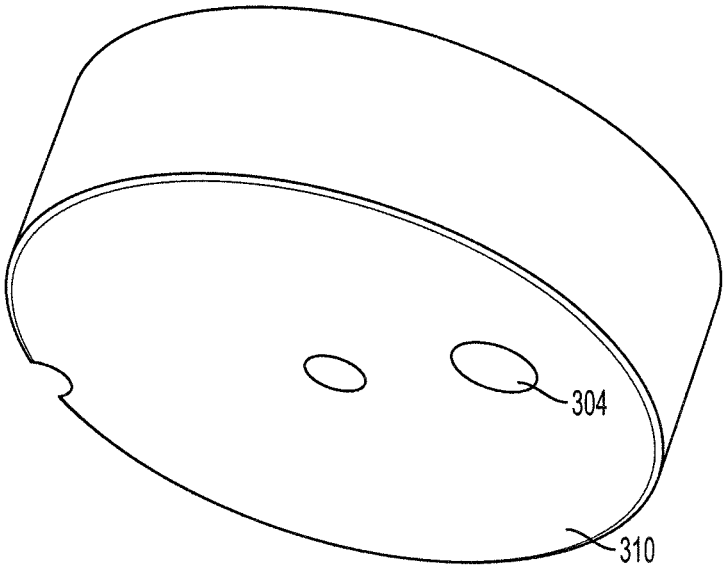
FIG. 3B shows a bottom perspective view of an example disk of the segmented vapor plug of FIG. 1 according to an aspect of the invention.

FIGS. 3A and 3B show a top perspective view and a bottom perspective view of the one of the one or more disks 116*a-e* that may be used to form the neck 104. Each disk of the one or more disks 116*a-e* may be approximately 1 inch thick and may be made from a polystyrene material. In various aspect of the present invention, the one or more disks 116*a-e* and the one or more sheets 112*a-d* have openings, indentations, extrusions or other features to interconnect and/or lock the one or more disks 116*a-e* and the one or more sheets 112*a-d*.

In one aspect of the present invention, each disk of the one or more disks 116*a-e* has a top surface 308, a bottom surface 310, and a central disk opening 306 or other feature that allows a connection between the one or more disks 116*a-e*. For example, the central disk opening 306 allows a fastener to interconnect the one or more disks 116*a-e* when the fastener is inserted through the central disk opening 306. Other features, such as extrusion 302 and extrusion 304 may assist in interconnecting the one or more disks 116*a-e*. For example, the top surface 308 may have an extrusion 302 that protrudes outward from the top surface 308. The bottom surface 310 may have an extrusion cavity 304 within the bottom surface 310. In some implementations, the top surface 308 has the extrusion cavity 304, and the bottom surface has the extrusion 302. The one or more disks 116*a-e* may use a combination of different features to interconnect.

The extrusion 302 of one disk may interconnect and interlock with the extrusion cavity 304 of another disk. The extrusion 302 may be shaped as a dimple or other protrusion. The extrusion cavity 304 may be an indentation, recess or other cavity that has a shape that corresponds to the shape of the extrusion 302.

When the extrusion 302 of a first disk is on the top surface 308 of the first disk, the extrusion 302 interconnects with an extrusion cavity 304 that is within a bottom surface 310 of a second disk that is placed above or on top of the first disk. The extrusion 302 of the first disk may lock with the extrusion cavity 304 of the second disk through an extrusion opening 404 of a sheet that is in between the first disk and the second disk. When the extrusion 302 of the first disk is on the bottom surface 310 of the first disk, the extrusion 302 interconnects with an extrusion cavity 304 that is within a top surface 308 of the second disk via an extrusion opening 404.

In one aspect of the present invention, the segmented vapor plug 100 has a thermocouple channel 114 that allows a lead wire of a thermocouple to exit the dewar 202. A thermocouple may be an electronic device or sensor that measures and/or monitors the temperature within the dewar 202 and may provide the temperature to another electronic device, such as a smart data logger. Each disk may have a disk channel 312 so that when the one or more disks 116*a-e* are aligned and interconnected form the thermocouple channel 114. For example, the disk channel 312 allows a portion of a thermocouple lead wire to be received. When the one or more disks 116*a-e* and the one or more sheets 112*a-d* are aligned and interconnected to form the neck 104, the one or more disk channels 312 of the one or more disks 116*a-e* are aligned and form the thermocouple channel 114. The thermocouple channel 114 allows a lead wire of a thermocouple to be received when the thermocouple is inserted into the dewar 202 without the thermocouple lead wire substantially protruding from the plane of the neck 104. That is, the thermocouple lead wire may be substantially within the plane of the surface of the neck 104 and/or does not break a plane of the surface of the neck 104.

Other similar devices of the segmented vapor plug 100 that assist in partially sealing the dewar 202 include the one or more sheets 112*a-d*. The one or more sheets 112*a-d* may be interconnected with the one or more disks 116*a-e* using a fastener to form the neck 104. Each sheet may be approximately 0.005 inches thick. In some implementations, the one or more sheets 112 and the one or more disks 116*a-e* are glued together using an adhesive to form the neck 104. In other implementations, the one or more sheets 112 and the one or more disks 116*a-e* are integrally molded together to form the neck 104.

Each sheet of the one or more sheets 112*a-d* may be positioned or arranged in between two of the one or more disks 116*a-e* or various other arrangements to form the neck 104. For example, the sheet 112*a* is positioned in between disk 116*a* and disk 116*b*, the sheet 112*b* is positioned in between 116*b* and 116*c*, and/or the sheet 112*c* is positioned in between 116*c* and 116*d*, and the sheet 112*d* is positioned in between disk 116*e* and disk 116*f*. In another example, the one or more sheets 112*a-d* may be positioned in a different order among the one or more disks 116*a-e*.

The one or more sheets 112*a-d* may be made from a flexible material, such as Tyvek. The one or more sheets 112*a-d* have a diameter that is greater than the diameter of the one or more disks 116*a-e*. The outer edge of the one or more sheets 112*a-d* may contact the inner diameter of the neck portion 206 of the inner vessel of the dewar 202. Since the one or more sheets 112*a-d* have a diameter that is greater than the diameter of the one or more disks 116*a-e*, an outer edge of each of the one or more sheets 112 may protrude outward away from the circumferential edges of the one or more disks 116*a-e*.

When the outer edges of the one or more sheets 112 protrude, the outer edges of the one or more sheets 112 may form one or more protrusions or fins along the length of the neck 104. Since the one or more sheets may be made from flexible material, the outer edges of the one or more sheets 112 or the one or more fins may be flexible. When pressure builds within the cavity of the dewar 202, the protruding portion of the one or more sheets 112 may bend to allow the pressure to equalize. The protruding portion of the one or more sheets 112 may contact the neck portion 206 of the inner vessel 204 of the dewar 202. The protruding portion may act as a conductive barrier or gate that reduces or prevents the evaporation of the liquid or gas stored in the cavity of the dewar 202. For example, when the dewar 202 is tilted, the protruding portion may inhibit the conductive flows of the liquid or gas stored in the cavity of the dewar to prevent evaporation and/or escape of the liquid or gas. Moreover, the protruding portion may reduce or prevent incoming warm air to fill the cavity of the inner vessel of the dewar 202.

Figure 4:
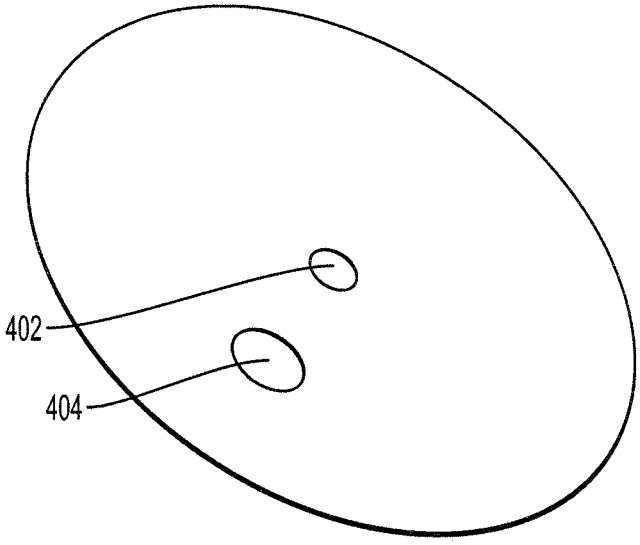
FIG. 4 shows an example sheet that forms a protrusion of the segmented vapor plug of FIG. 1 according to an aspect of the invention.
Figure 5:
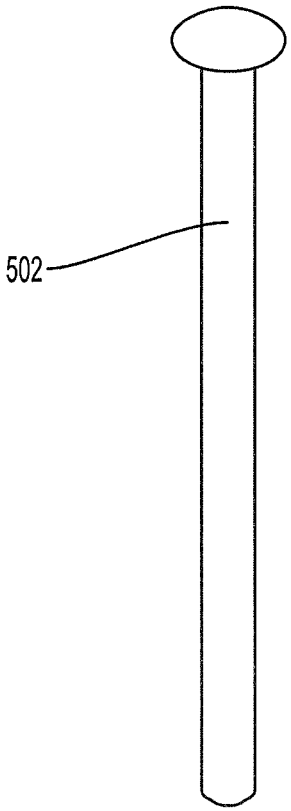
FIG. 5 shows an example center pin that interconnects various components of the segmented vapor plug of FIG. 1 according to an aspect of the invention.

The one or more sheets 112*a-d* each may have a fastener opening 402 and an extrusion opening 404, as shown in FIG. 4 for example, or other features that assist in interconnecting the one or more disks 116*a-e* and the one or more sheets 112*a-d*. The fastener opening 402 may be centrally located within each of the one or more sheets 112*a-d*. The fastener opening 402 may allow a fastener to be inserted to interconnect the one or more disks 116*a-e* and the one or more sheets 112*a-d* in between the vapor plug cover 102 and the plate 106. The extrusion opening 404 of a sheet, such as the sheet 112*a*, allows an extrusion 302 of a first disk, such as the disk 116*a*, to interlock with an extrusion cavity 304 of a second disk, such as the disk 116*b*, to lock and align the two disks 116*a-b* together with the sheet 112*a* in between. The extrusion 302 of one disk is inserted through the extrusion opening 404 of the sheet into the extrusion cavity 304 of another disk to interlock the two disks and the sheet. The extrusion opening 404 may be circular, angular or other polygonal shape to allow an extrusion 302, such as a dimple or other protrusion, to interlock with the extrusion cavity 304.

The segmented vapor plug 100 may have a plate 106, a fastener or other device to hold the components that form the neck 104 in place. For example, the plate 106 may be positioned at a bottom of the segmented vapor plug 100 that is inserted into the neck portion 206 of the dewar 202. The plate 106 may be on one end of the fastener that is opposite the end of the fastener that connects to the vapor plug cover 102. In between the plate 106 and the vapor plug cover 102 are the one or more disks 116*a-e* and the one or more sheets 112*a-d*. The plate 106 may be circular shaped, such as in the shape of a disk, and may be made from nylon. The plate 106 may have a plate opening that is centrally located in the plate 106.

When the plate 106, the one or more disks 116*a-e*, the one or more sheets 112*a-d* and the recess 126 of the vapor plug cover are aligned, the fastener may be inserted through the plate opening of the plate 106 and the one or more fastener openings 402 of the one or more sheets 112*a-d* and the one or more central disk openings 306 of the one or more disks 116*a-e* to be received in the recess 126 of the vapor plug cover 102. The fastener interconnects the plate 106, the one or more sheets 112*a-d*, the one or more disks 116*a-e* and the vapor plug cover 102.

The fastener may include a nut 108 and/or a central pin 502. The central pin 502 may be inserted into each of the one or more openings of the sheets, disks, nut and/or plate. The one or more openings form a corridor 110 when the sheets, disks, nut and/or plate are aligned for insertion of the central pin 502 or other connector. The central pin 502 may be inserted into an opening of the nut 108, such as a push nut, which may be positioned against the plate 106. The central pin 502 exerts a force onto the nut 108 to push against the plate 106 to hold the one or more sheets 112*a-d* and the one or more disks 116*a-e* in place to form the neck 104. The nut 108 provides an interface between a head of the central pin 502 and the plate 106. The central pin 502 holds the one or more disks 116*a-e* and the one or more sheets 112*a-d* together in between the plate 106 and the vapor plug cover 102 to form the neck 104.

Figure 6:
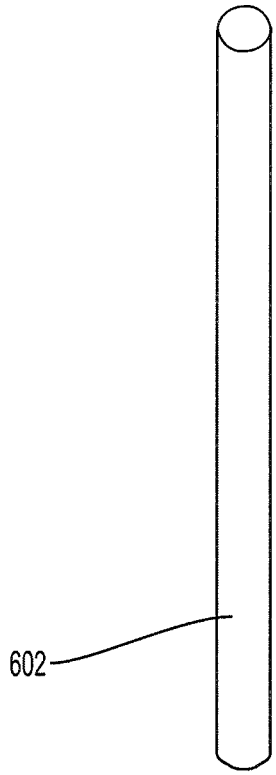
FIG. 6 shows an example tube that interconnects various components of the segmented vapor plug of FIG. 1 according to an aspect of the invention.

In some implementations, the fastener may include a tube 602, as shown in FIG. 6 for example, instead of the central pin 502. The tube 602 may be inserted into the corridor 110 to interconnect the various components. The tube 602 may be inserted into each of the one or more openings of the sheets, disks, nut, and/or plate, and may serve as an additional vent for gas as well as a place to insert a temperature probe.

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A vapor plug, comprising:

a vapor plug cover that is configured to cover an opening of a container;

a neck formed from a plurality of disks and a plurality of sheets and having a thermocouple channel along an outer periphery of the neck, wherein the vapor plug cover has a circumference greater than a circumference of the neck and the neck is configured to be inserted into the opening of the container; and a fastener that connects the plurality of disks, the plurality of sheets and the vapor plug cover.

2. The vapor plug of claim 1, wherein a portion of each sheet of the plurality of sheets extends outward from the plurality of disks and is configured to obstruct gas or liquid that escapes the container and reduces evaporation of the gas or liquid within the container.

3. The vapor plug of claim 2, wherein the portion of each sheet that extends outward from the plurality of disks is a fin.

4. The vapor plug of claim 1, wherein each disk of the plurality of disks has a top surface and a bottom surface, wherein the top surface has a dimple and the bottom surface has a cavity, wherein a shape of the dimple corresponds with a shape of the cavity.

5. The vapor plug of claim 4, wherein the plurality of disks include a first disk and a second disk, wherein the dimple of the first disk interlocks with the cavity of the second disk.

6. The vapor plug of claim 1, wherein the vapor plug cover has a recess that is configured to receive the fastener, wherein the fastener has a pin that is configured to be inserted into the recess of the vapor plug cover and through an opening in each disk of the plurality of disks and in each sheet of the plurality of sheets to connect the plurality of disks and the plurality of sheets with the vapor plug cover.

7. The vapor plug of claim 6, wherein the fastener has a push nut and a plate, wherein the plate is positioned at an end of the neck and opposite the vapor plug cover, wherein the plurality of disks and the plurality of sheets are positioned between the vapor plug cover and the plate, wherein a head of a pin is configured to push against the push nut and the plate to hold the plurality of disks and the plurality of sheets in between the plate and the vapor plug cover.

8. The vapor plug of claim 1, wherein each disk of the plurality of disks has a channel, wherein the channel of each disk is aligned with the channel of the other disks of the plurality of disks to form the thermocouple channel of the neck when the plurality of disks form the neck.

9. The vapor plug of claim 1, wherein each disk of the plurality of disks and each sheet of the plurality of sheets has a central cylindrical opening that is configured to receive the fastener to connect the plurality of disks and the plurality of sheets with the vapor plug cover.

10. The vapor plug of claim 1, wherein the plurality of disks are made from a polystyrene material, wherein the plurality of sheets are formed from Tyvek.

11. A cryogenic storage or transport system, comprising:

a dewar having an inner vessel and an outer vessel; and a vapor plug positioned within the inner vessel of the dewar such that there is a gap between the vapor plug and the inner vessel, the vapor plug having:

a vapor plug cover that is configured to cover an opening of the dewar;

a neck formed from a plurality of disks and a plurality of sheets, the neck having a thermocouple channel along an outer periphery of the neck and being configured to be inserted into the opening of the dewar; and a fastener that connects the plurality of disks, the plurality of sheets and the vapor plug cover.

12. The cryogenic storage or transport system of claim 11, wherein the neck is cylindrically shaped and the plurality of disks and the plurality of sheets are cylindrically shaped, wherein an outer diameter of each sheet of the plurality of sheets is greater than an outer diameter of each disk of the plurality of disks to form a plurality of protrusions within the inner vessel of the dewar.

13. The cryogenic storage or transport system of claim 12, wherein the fastener is inserted through a central opening in each disk, a central opening in each sheet, and into a recess of the vapor plug cover to interconnect each disk, each sheet and the vapor plug cover.

14. The cryogenic storage or transport system of claim 12, wherein the fastener includes a push nut and a central pin, wherein the central pin is inserted in an opening in each disk of the plurality of disks and an opening in each sheet of the plurality of sheets, wherein the plurality of disks and the plurality of sheets are positioned between a plate and the vapor plug cover, wherein the central pin is inserted into the push nut and the plate to hold the plurality of sheets and the plurality of disks in between the plate and the vapor plug cover.

15. A vapor plug, comprising:

a vapor plug cover configured to cover an opening of a dewar;

a plurality of disks;

a plurality of sheets, each sheet of the plurality of sheets being sandwiched in between two disks of the plurality of disks and having a portion that protrudes away from the two disks to reduce evaporation of gases within the dewar; and a fastener that is configured to connect the vapor plug cover, the plurality of disks and the plurality of sheets.

16. The vapor plug of claim 15, wherein the plurality of disks are formed from a polystyrene material.

17. The vapor plug of claim 15, wherein the vapor plug cover has a recess that is configured to receive the fastener, wherein the fastener has a central pin that is configured to be inserted into the recess of the vapor plug cover and through an opening in each disk of the plurality of disks and an opening in each sheet of the plurality of sheets to connect the plurality of disks and the plurality of sheets with the vapor plug cover.

18. The vapor plug of claim 15, wherein the plurality of disks include a first disk and a second disk, wherein a dimple of the first disk interlocks with a recess of the second disk.

* * * * *